US010980389B2

(12) United States Patent
Holmes

(10) Patent No.: US 10,980,389 B2
(45) Date of Patent: Apr. 20, 2021

(54) BASEBOARD CLEANING DEVICE

(71) Applicant: Joshua Timothy-Hugh Holmes, Akron, OH (US)

(72) Inventor: Joshua Timothy-Hugh Holmes, Akron, OH (US)

( * ) Notice: Subject to any disclaimer, the term of this patent is extended or adjusted under 35 U.S.C. 154(b) by 67 days.

(21) Appl. No.: 14/134,980

(22) Filed: Dec. 19, 2013

(65) Prior Publication Data

US 2020/0009713 A1 Jan. 9, 2020

Related U.S. Application Data

(60) Provisional application No. 61/739,852, filed on Dec. 20, 2012.

(51) Int. Cl.

| | |
|---|---|
| ***A47L 13/16*** | (2006.01) |
| ***A47L 13/256*** | (2006.01) |
| ***B25G 1/04*** | (2006.01) |
| ***B25G 3/38*** | (2006.01) |
| ***A47L 13/44*** | (2006.01) |
| ***A47L 13/257*** | (2006.01) |
| ***A47L 13/254*** | (2006.01) |
| ***A47L 13/42*** | (2006.01) |

(52) U.S. Cl.

CPC ..... *A47L 13/256* (2013.01); *A47L 13/16* (2013.01); *A47L 13/254* (2013.01); *A47L 13/257* (2013.01); *A47L 13/42* (2013.01); *A47L 13/44* (2013.01); *B25G 1/04* (2013.01); *B25G 3/38* (2013.01)

(58) Field of Classification Search

CPC ..... B25G 1/04; B25G 3/38; A47L 13/256; A47L 13/257; A47L 13/44; A47L 13/16; A47L 13/46; A46B 11/00

USPC ..... 15/160, 210.1, 231, 119.2, 228, 244.1; 401/183, 196

See application file for complete search history.

(56) References Cited

U.S. PATENT DOCUMENTS

2004/0107525 A1* 6/2004 Newman ..... B05C 17/00 15/210.1

* cited by examiner

*Primary Examiner* — Mark Spisich
*Assistant Examiner* — Katina N. Henson
(74) *Attorney, Agent, or Firm* — Pearne & Gordon LLP

(57) ABSTRACT

A device for cleaning the base of a wall generally compromises an extendable handle retaining member that is free to swivel about a predetermined range of motion. This action also allows you to get into those hard-to-reach areas without bending, stooping, or kneeling for prolonged periods. The placement of the handle will allow the device to be steered or guided more easily than other wheelbase arrangements. A base member includes a plurality of wheels on a wheelbase to allow the base member to balance on its wheelbase unaided. This is also used for sturdiness and durability. This device has several cleaning attachments such as a sponge, a scouring pad, a dust mop, and a wringer mop to accommodate baseboards of various dimensions.

10 Claims, 5 Drawing Sheets

BASEBOARD CLEANING DEVICE

BACKGROUND OF THE INVENTION

A. Field of Invention

The present invention relates to cleaning baseboards and/or the base of a wall. It relates to a device for cleaning residential and commercial baseboards which may be used on floors and walls. More specifically the invention is drawn to cleaning attachments such as a broom attachment, a wringer mop attachment, a dust mop attachment, and a scouring attachment. More particularly the invention relates to a device that may be operated without extensive bending, squatting, or stooping.

B. Description of the Related Art

The base of a wall and or baseboards is customarily cleaned with a broom, a mop, by hand, or by foot. Cleaning baseboards with primarily a broom may scratch certain baseboards, Cleaning baseboards primarily with a mop will not be effective on carpet. Hand cleaning by an individual may require bending, stooping, and/or kneeling for prolonged periods. Such activities may cause discomfort of injury (e.g., back injury) to the individual performing the cleaning operation. Cleaning a baseboard by placing a sock on one's foot and spraying a cleaning solution to the base while one glides their foot across the baseboard to clean may cause discomfort and possible callous to the foot Some embodiments of the present invention may provide one or more benefits or advantages over the prior art.

SUMMARY OF THE INVENTION

Some embodiments may relate to device for cleaning the base of a wall and may Include a base member and also may include a plurality of wheels. Such wheels may attach to the base to allow the base member to roll on a surface such as a floor or a wall. The spacing of the wheels may be suitable to allow the base member to balance on its wheels unaided. A base member may include a cleaning attachment retaining member. A cleaning retaining member may be adapted to reversibly receive a cleaning attachment such as a sponge or other cleaning implement. Embodiments may include a handle retaining member which may be defined by a portion of the base member. Wherein the handle retaining member is free to swivel about a predetermined range of motion and is adapted to receive a handle in a fixed motion. The placement of the handle may allow the device to be steered or guided more easily than other wheelbase arrangements. A swivel feature may provide the handle with a wide range of motion which may include and position between perpendicular and parallel relative to a cleaning attachment retaining member. In fact, a suitable range of motion may even provide motion beyond the range from perpendicular to parallel. Suitable cleaning attachment can include a wide variety of implements which can be rendered in a generally planar configuration. A sponge attachment may be suitable for applying cleaning liquids to a baseboard. A plastic scouring attachment may provide added roughness for removing difficult stains. Further, these attachments and any other added attachments may range is sizes from one inch, three inches, and five inches depending on the size of the baseboards.

Other benefits and advantages will become apparent to those skilled in the art to which it pertains upon reading and understanding of the following detailed specification.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION OF THE INVENTION

Figure 3:
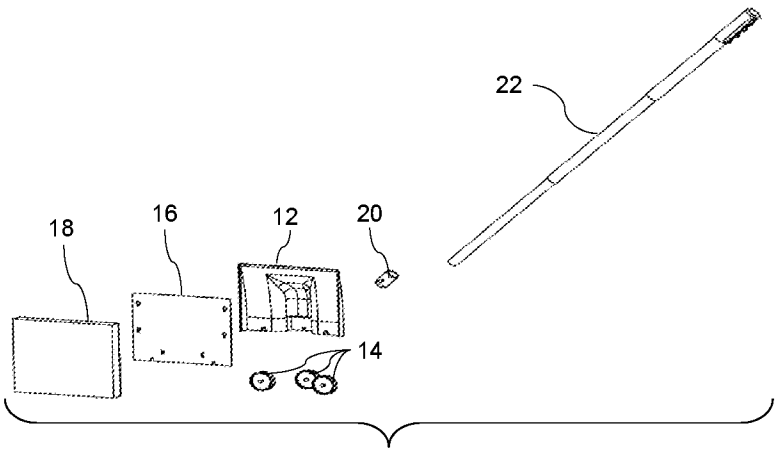
FIG. 3 is an exploded view of the cleaning device.
Figure 1:
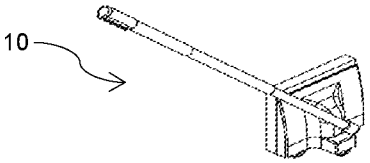
FIG. 1 is a perspective view of a baseboard cleaning device according to an example embodiment of the present disclosure.
Figure 2:
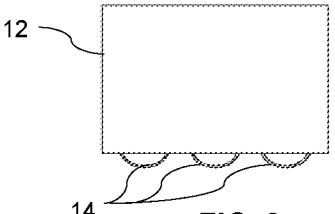
FIG. 2 is bottom view of a base member of the cleaning device.
Figure 8B:
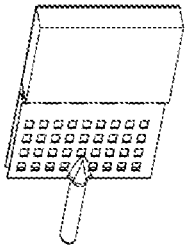
FIGS. 8A and 8B show various views of a baseboard cleaning device according to another example embodiment.
Figure 9:
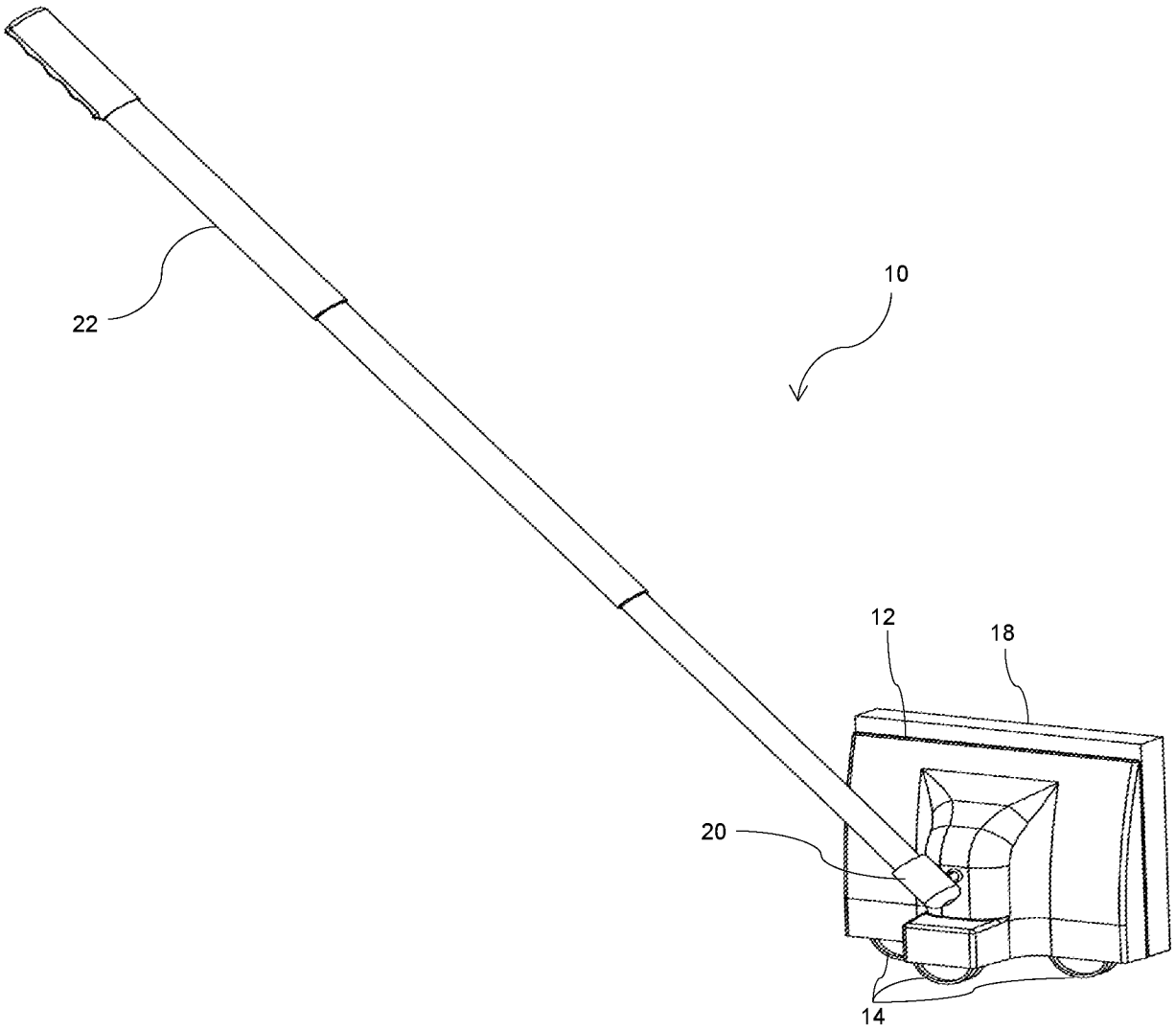
FIGS. 9-11 are various perspective views of the cleaning device.
Figure 10:
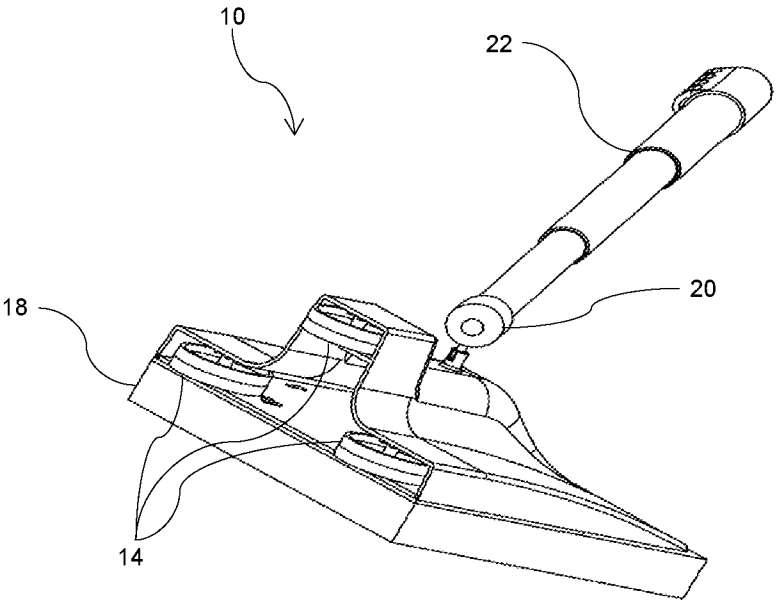
Figure 11:
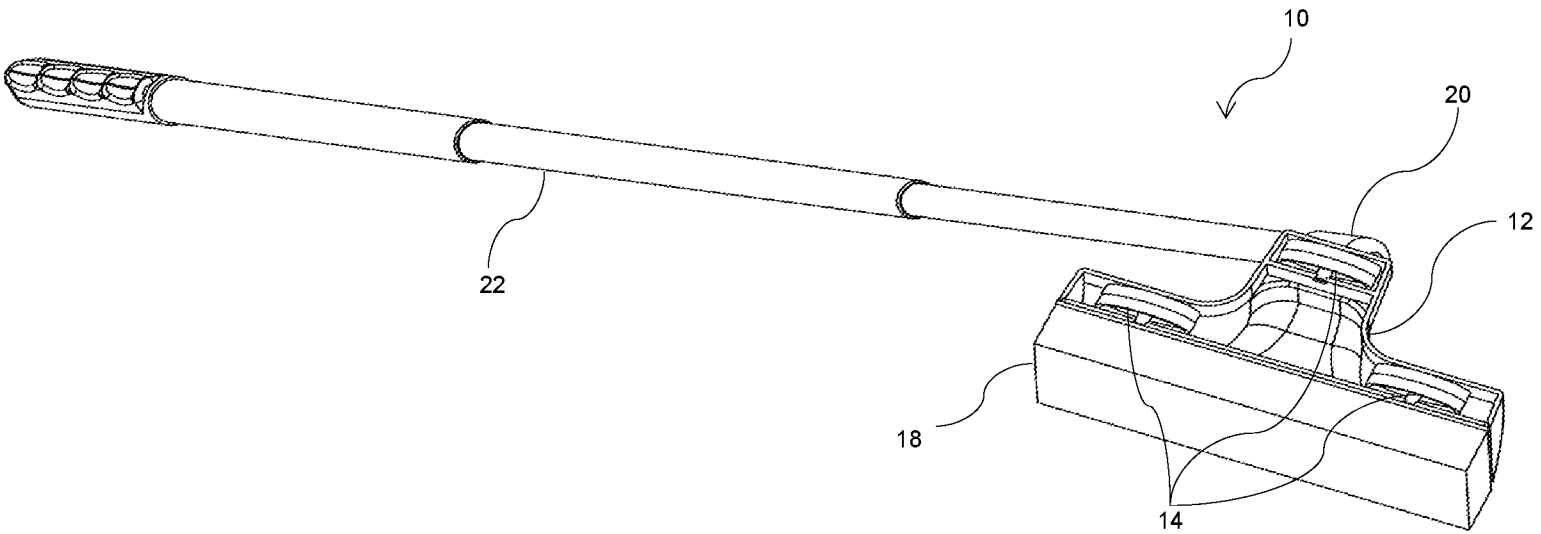

With reference to FIGS. 1-3 and 9-11, embodiments may comprise a device 10 suitable for cleaning Items such as baseboards, and may include a base member 12. A base member 12 may include a plurality of wheels 14 defining a wheelbase, such as a triangular wheelbase or a rectangular wheelbase. Such wheels 14 may attach to the base member 12 in a rotatable relation adapted to allow the base member to roll on a surface such as a floor or wall. Furthermore, according to some embodiments, the spacing of the wheels 14 of the wheelbase may be suitable to allow the base member 12 to balance on its wheelbase unaided. A base member 12 may include a cleaning attachment retaining member 16, which may be defined by a portion of the base member and oriented parallel to a side of the wheel base. For instance, in the case of a triangular wheelbase, the cleaning attachment retaining member 16 may be oriented parallel to a leg of the triangular wheelbase. Furthermore, a cleaning attachment retaining member 16 may be adapted to reversibly receive a cleaning attachment 18 such as a sponge or other cleaning implement. Embodiments may also include a handle retaining member 20, which may be defined by a portion of the base member. The handle retaining member 20 may be disposed in a distal orientation relative to the cleaning attachment retaining member 16. For instance, in the case of a triangular wheelbase, a handle retaining member 20 may be disposed at a vertex of the triangular wheelbase distal from the cleaning attachment retaining member, wherein the handle retaining member 20 is free to swivel about a predetermined range of motion, and wherein the handle retaining member 20 is adapted to receive a handle 22 in a fixed relation.

While embodiments set forth herein may be particularly well adapted to cleaning baseboards, one skilled In the art will recognize that the invention is not limited to cleaning baseboards. Rather, embodiments may also be directed to cleaning other areas such as walls or floors, or hard-to-reach areas between appliances and may be specialty adapted to such uses within the scope of the present invention.

Wheelbases according to embodiments of the invention may include triangular arrangements. Such an arrangement tends to locate the center of mass of the device so as to stabilize the device when placed in an orientation with the wheels on a horizontal surface. Furthermore, a triangular wheelbase enables placement of a handle at a vertex of the wheelbase distal to a cleaning surface. This placement of the handle may allow the device to be steered or guided more easily than other wheelbase arrangements. However, the present invention is not limited to triangular wheelbases, but rather includes rectangular arrangements, and other arrangements as would be understood by one skilled in the art Similarly, the wheelbase is not limited to three wheels, but rather may function with more wheels or even fewer wheels, e.g. one or two wheels, having an appropriate width suitable for stabilizing the device similar to that of a triangular wheelbase.

Embodiments may include a cleaning attachment retaining member adapted to reversibly receive a cleaning attachment One skilled in the art will recognize that a wide variety of means exist for attaching a generally planar cleaning attachment to a base member as described herein. For instance, a base member may be defined by a polymer sheet material which has been formed to a predetermined shape, and which includes flaps folded over to form a means for sliding in planar cleaning attachment. However, one skilled in the art will recognize that a base member may be alternatively formed to include pegs, pins, snaps, brackets, latches, or locking mechanisms for reversibly mounting a planar cleaning attachment to the base member. While the embodiments set forth in detail herein depict a cleaning attachment retaining means which defines a perimeter within which a cleaning attachment is retained, one skilled in the art will recognize that the invention is not limited to such embodiments. Rather, any of a wide variety of means for mounting a generally planar cleaning attachment to a base member, as are known in the art, may be suitable.

A suitable means 20 for retaining a handle 22 to a base member 12 includes one which enables the handle 22 to move relative to the base member 12. More specifically, particularly suitable means may include a swivel feature which provides the handle 22 with a wide-angle range of motion which may include any position between perpendicular and parallel relative to a cleaning attachment retaining member 16. In fact, a suitable range of motion may even provide motion beyond the range from perpendicular to parallel.

Figure 7:
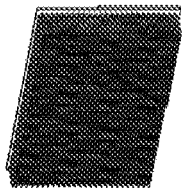
FIGS. 4A-4C, 5A-5C 6 and 7 illustrate various example cleaning attachments that may be used with the cleaning device.
Figure 8A:
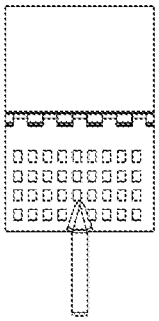
Figure 6:
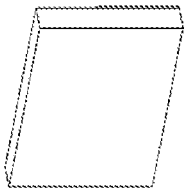
Figure 5A:
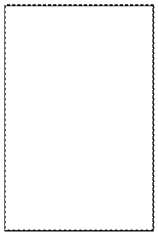
Figure 5B:
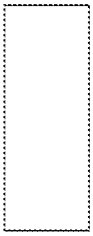
Figure 5C:
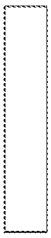
Figure 4A:
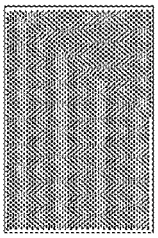
Figure 4B:
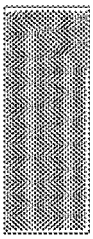
Figure 4C:
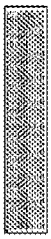

With reference to the examples shown in FIGS. 4A-4C, 5A-5C 6 and 7, suitable cleaning attachments can include any of a wide variety of implements which can be rendered in a generally planar configuration. For instance, a sponge attachment may be suitable for applying cleaning liquids to a baseboard or other surface. A plastic scouring attachment may provide added roughness for removing more difficult stains. Indeed, one skilled in the art will appreciate that a wide variety of roughness, grits, and liquid retention properties and/or combinations thereof can be appropriate depending on the specific application.

Embodiments having been described hereinabove, it will be apparent to those skilled in the art that the above methods and apparatuses may incorporate changes and modifications without departing from the general scope of this invention. The invention is intended to include all such modifications and alterations insofar as they come within the scope of the appended claims or the equivalents thereof.

I claim:

1. A baseboard cleaning device comprising:

a base member including a plurality of wheels spaced apart to define a generally triangular wheelbase, wherein the plurality of wheels attach to the base member in a rotatable relation adapted to allow the base member to roll on a floor, wherein at least two of the plurality of wheels define a first plane and at least one of the plurality of wheels define a second plane;

wherein the first plane and the second plane are offset from each other to enable the plurality of wheels of the base member to engage a same planar surface;

a cleaning attachment retaining member defined by a portion of the base member and oriented parallel to a leg of the triangular wheelbase, wherein the attachment retaining member is adapted to reversibly receive a cleaning attachment;

and a handle retaining member defined by a portion of the base member and disposed at a vertex of the triangular wheelbase distal from the cleaning attachment retaining member, wherein the handle retaining member is free to swivel about a predetermined range of motion, and wherein the handle retaining member is adapted to receive a handle in a fixed relation.

2. The device of claim 1, further comprising a handle fixedly engaging the handle retaining member.

3. The device of claim 2, wherein the handle includes a telescoping feature permitting the handle to extend and retract as determined by a user.

4. The device of claim 1, wherein the cleaning attachment defines a generally planar surface fixed in a retaining relation with the cleaning attachment retaining member of the base member.

5. The device of claim 4, wherein the cleaning attachment further comprises a disposable cleaning member.

6. The device of claim 5, wherein the disposable cleaning member is selected from one or more of a sponge, a brush, a dust mop, or a plastic scouring pad.

7. The device of claim 6, wherein the disposable cleaning member is permanently joined to the cleaning attachment, or reversibly joined to the cleaning attachment.

8. The device of claim 1, wherein the device is adapted to balance on the plurality of wheels of the wheelbase unaided.

9. The device of claim 1, wherein the cleaning attachment comprises a generally planar cleaning surface that extends away from the wheelbase in a radial direction of the wheels.

10. A baseboard cleaning device comprising:

a base member including a plurality of wheels spaced apart to define a generally triangular wheelbase, wherein the wheels attach to the base member in a rotatable relation adapted to allow the base member to roll on a floor, and wherein the wheelbase of the base member is adapted to engage a same planar surface;

a cleaning attachment retaining member defined by a portion of the base member and oriented parallel to a leg of the triangular wheelbase, wherein the attachment retaining member is adapted to reversibly receive a cleaning attachment having generally planar cleaning surface that extends away from the wheelbase in a radial direction of the wheels, the cleaning surface being adapted to contact a baseboard or a base of a wall for cleaning; and a handle retaining member defined by a portion of the base member and disposed at a vertex of the triangular wheelbase distal from the cleaning attachment retaining member, wherein the handle retaining member is free to swivel about a predetermined range of motion, and wherein the handle retaining member is adapted to receive a handle in a fixed relation.

* * * * *